US008195376B2

(12) United States Patent
Yuzaki et al.

(10) Patent No.: US 8,195,376 B2
(45) Date of Patent: Jun. 5, 2012

(54) FUEL INJECTION CONTROL DEVICE FOR DIESEL ENGINE

(75) Inventors: Keiichiro Yuzaki, Osaka (JP); Tomohiro Ootani, Osaka (JP); Gou Asai, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 342 days.

(21) Appl. No.: 12/529,860

(22) PCT Filed: Mar. 4, 2008

(86) PCT No.: PCT/JP2008/053806

§ 371 (c)(1),
(2), (4) Date: Sep. 3, 2009

(87) PCT Pub. No.: WO2008/111422

PCT Pub. Date: Sep. 18, 2008

(65) Prior Publication Data

US 2010/0100303 A1 Apr. 22, 2010

(30) Foreign Application Priority Data

Mar. 5, 2007 (JP) ..... 2007-54596
Mar. 5, 2007 (JP) ..... 2007-54597

(51) Int. Cl.
*F02D 41/30* (2006.01)
*F02M 63/00* (2006.01)

(52) U.S. Cl. ..... 701/103; 123/447

(58) Field of Classification Search ..... 701/102–105; 123/299, 305, 435–436, 446–447
See application file for complete search history.

(56) References Cited

U.S. PATENT DOCUMENTS

| | | | | |
|---|---|---|---|---|
| 7,272,486 | B2 * | 9/2007 | Speetzen et al. | 701/105 |
| 7,558,665 | B1 * | 7/2009 | Geveci et al. | 701/104 |
| 7,848,874 | B2 * | 12/2010 | Hay et al. | 701/113 |
| 7,891,339 | B2 * | 2/2011 | Takahashi et al. | 123/447 |
| 7,987,704 | B2 * | 8/2011 | Lucido et al. | 73/114.43 |
| 2003/0121501 | A1 * | 7/2003 | Barnes et al. | 123/446 |
| 2004/0211395 | A1 * | 10/2004 | Greco et al. | 123/497 |
| 2005/0103311 | A1 * | 5/2005 | Adachi et al. | 123/456 |

(Continued)

FOREIGN PATENT DOCUMENTS

JP 11-270385 10/1999

(Continued)

OTHER PUBLICATIONS

International Search Report for International Application No. PCT/JP2008/053806 dated May 30, 2008, 2 pgs.

*Primary Examiner* — John T. Kwon
*Assistant Examiner* — Johnny Hoang
(74) *Attorney, Agent, or Firm* — Sterne, Kessler, Goldstein & Fox P.L.L.C.

(57) ABSTRACT

A fuel injection control device for a diesel engine controls the first fuel injection timing so as to reduce the amount of white smoke generated in large amounts immediately after starting an engine. The fuel injection control device for the diesel engine comprises a high-pressure pump, a common rail for accumulating a highly-pressured fuel, injectors for injecting the fuel into a combustion chamber and a control means. Due to the fuel injection control device for the diesel engine, the fuel injection is performed after the cranking, without injecting the fuel for a certain period of time after an engine starting switch is turned on so that the pressure in the common rail becomes a set value.

7 Claims, 8 Drawing Sheets

U.S. PATENT DOCUMENTS

| | | | | |
|---|---|---|---|---|
| 2005/0126539 | A1* | 6/2005 | Okamoto | 123/446 |
| 2005/0229896 | A1* | 10/2005 | Hori | 123/198 D |
| 2008/0022966 | A1* | 1/2008 | Tamma et al. | 123/299 |
| 2008/0307870 | A1* | 12/2008 | Chemello | 73/114.51 |

FOREIGN PATENT DOCUMENTS

| | | | |
|---|---|---|---|
| JP | 2003-083103 | | 3/2003 |
| JP | 2003-106195 | | 4/2003 |
| JP | 3418996 | B2 | 6/2003 |
| JP | 3473211 | B2 | 12/2003 |
| JP | 3580099 | B2 | 10/2004 |
| JP | 2006-188971 | | 7/2006 |
| JP | 2006-291903 | | 10/2006 |

* cited by examiner

FUEL INJECTION CONTROL DEVICE FOR DIESEL ENGINE

BACKGROUND OF THE INVENTION

1. Field of the Invention

The present invention relates to a fuel injection control device for a diesel engine, and more specifically relates to a fuel injection control device for a diesel engine for controlling the first fuel injection command soon after a cranking at the time of starting the engine.

2. Related Art

A fuel injection control device for a diesel engine includes a common-rail fuel injection control device. In the common-rail fuel injection control device, fuel is accumulated into a common rail by a high-pressure pump, and the fuel is injected from an injector into a combustion chamber by opening and closing a solenoid valve. The fuel injection timing and fuel injection quantity are controlled by the energization of the solenoid valve in the injector, depending on the specified engine rotating speed, the load or the like. Cranking is started by a starter, and then a cylinder engine in which the fuel is first injected is determined by a cylinder engine determining sensor as well as a fuel injection command signal is issued from an engine control unit (hereinafter, referred to as "ECU") to the solenoid valve in the injector, whereby the engine is started. Briefly, the fuel injection is started immediately after the cranking has been started and the cylinder engine is determined. In order to increase the rail pressure of the common rail at the time of starting the engine, a discharge rate of the fuel from the high-pressure pump is set up to be maximized shortly after the cranking. With regard to the common-rail fuel injection device mentioned above, the following fuel injection devices are disclosed, wherein the fuel injection is divided into a main injection and a pilot injection before the main injection, so as to slack a combustion by the main injection (for example, see Patent Literature 1), so as to control the pilot injection (for example, see Patent Literature 2) or so as to reduce the amount of white smoke at the time of starting the engine by further injecting a small amount of fuel before the pilot injection or the like (for example, see Patent Literature 3).

Patent Literature 1: the Japanese Patent Laid Open Gazette 3473211

Patent Literature 2: the Japanese Patent Laid Open Gazette 3418996

Patent Literature 3: the Japanese Patent Laid Open Gazette 3580099

DISCLOSURE OF INVENTION

Problems to be Solved by the Invention

In the conventional fuel injection control device described above, the fuel injection is started soon after the cranking, and the time from the immediate aftermath of the cranking until the initiation of the fuel injection is not controlled.

When the fuel is injected before reaching a given injectable common rail pressure, the injection from the injector into the combustion chamber becomes unstable. When the fuel is injected into the combustion chamber on the condition that the combustion chamber is at low temperature just after the cranking, the fuel is not fully evaporated, so a large amount of fuel having no contribution to the combustion is accumulated into the combustion chamber. Since the fuel accumulated into the combustion chamber is discharged from the combustion chamber at once when the ignition is performed thereafter, a great deal of white smoke is generated immediately after starting the engine.

Because the fuel is leaked from the injector, the time until the common rail pressure reaches the given injectable pressure becomes longer, thereby lengthening the time until starting the engine.

In consideration of the aforementioned problems, it's an objective of the present invention to provide a fuel injection control device for a diesel engine that can control the first fuel injection timing and that can reduce the amount of white smoke generated in large amounts soon after starting the engine.

BRIEF SUMMARY OF THE INVENTION

Means for Solving the Problem

In order to achieve the above-mentioned objectives, in the first embodiment of the present invention, a fuel injection control device for a diesel engine comprises a high-pressure pump, a common rail for accumulating a highly-pressured fuel pressurized and sent from the high-pressure pump, injectors for injecting the fuel supplied from the common rail into a combustion chamber, and a control means for controlling the injectors to perform the first fuel injection command soon after a cranking and after the rail pressure of the common rail reaches a predetermined pressure.

Due to the above construction, the fuel having no contribution to the combustion generated due to a lack of the rail pressure is not leaked and accumulated in the combustion chamber. The amount of fuel leaked from the injector is reduced and the time until the rail pressure reaches the injectable pressure is shortened.

With respect to the second embodiment of the present invention, the fuel injection control device for the diesel engine of the first embodiment further comprises a detecting means for detecting an engine temperature, and a setting means for setting up the predetermined pressure based on the detected engine temperature.

Due to the above construction, the setting pressure is varied depending on the engine temperature.

With respect to the third embodiment of the present invention, the engine temperature of the second embodiment is calculated based on at least the coolant water temperature.

Due to the above construction, the setting pressure is varied depending on the coolant water temperature of the engine.

With respect to the fourth embodiment of the present invention, the fuel injection control device for the diesel engine further comprises a starter for starting an operation by turning on an engine starting switch, a setting means for setting up a non-fuel injection time when the cranking is continuously performed by the starter using battery power, and a control means for controlling the injectors performing the first fuel injection command after the lapse of the non-fuel injection time.

Due to the above construction, the temperature in the combustion chamber is increased due to the cranking during the non-fuel injection time, and the rail pressure of the common rail is increased during the non-fuel injection time.

With respect to the fifth embodiment of the present invention, the fuel injection control device for the diesel engine of the fourth embodiment further comprises a detecting means for detecting the engine temperature, wherein the non-fuel injection time is set based on the detected engine temperature.

Due to the above construction, the non-fuel injection time is varied depending on the engine temperature.

With respect to the sixth embodiment of the present invention, the engine temperature of the fifth embodiment is calculated based on at least the coolant water temperature.

Due to the above construction, the non-fuel injection time is varied depending on the coolant water temperature.

With respect to the seventh embodiment of the present invention, when the non-fuel injection time of the fourth embodiment is longer than the available continuous cranking time, the cranking is performed without injecting the fuel during the available continuous cranking time and the setting means newly sets the non-fuel injection time after the cranking is stopped.

Due to the above construction, battery power is stable without being rapidly decreased, and the continuous operating time of the starter does not become longer than the predefined time.

With respect to the eighth embodiment of the present invention, re-cranking performed during the newly set non-fuel injection time of the seventh embodiment is automatically started.

Due to the above construction, re-cranking is repeated until the engine is started.

With respect to the ninth embodiment of the present invention, the fuel injection command of the fourth embodiment is issued to the injector attached to the cylinder engine having the highest intake air temperature.

Due to the above construction, the first explosion is easily performed, and the compression end temperature of the cylinder engine in which the fuel is secondly injected is increased due to the torque by the cylinder engine in which the first explosion was made, thereby enhancing the ignition.

With respect to the tenth embodiment of the present invention, the pressure feeding quantity of the fuel pressurized and sent from the high-pressure pump per unit time of the fourth embodiment is reduced, so that the time until the fuel injection command is issued approximately coincides with the time until the rail pressure of the common rail reaches a target pressure.

Due to the above construction, the fuel pressure feeding quantity from the high-pressure pump to the common rail just after starting the cranking needs not to be maximized.

With respect to the eleventh embodiment of the present invention, the setting means and the control means of the fourth embodiment are set up so as not to be performed when the voltage of the battery is a predetermined value or lower.

Due to the above construction, excessive burdens are not placed on the battery.

Effect of the Invention

As described above, according to the first embodiment of the present invention, because the fuel having no contribution to the combustion generated due to a lack of the rail pressure is not accumulated in the combustion chamber, the amount of white smoke generated in large amounts soon after starting the engine can be reduced. The amount of fuel leaked from the injector is reduced and the time until the rail pressure reaches the injectable pressure is shortened, so that the time until the engine is started can be shortened.

According to the second embodiment of the present invention, in addition to the effect of the first embodiment, since the setting pressure is varied depending on the engine temperature, the white smoke is reduced and the optimal engine starting time is set so that efficient engine starting can be performed.

According to the third embodiment of the present invention, in addition to the effect of the second embodiment, since the setting pressure is varied depending on the coolant water temperature, the engine temperature most suitable for starting the engine can be calculated and more efficient engine starting can be performed.

According to the fourth embodiment of the present invention, as the temperature in the combustion chamber is increased due to the cranking during the non-fuel injection time and the rail pressure of the common rail is increased during the non-fuel injection time, the fuel having no contribution to the combustion accumulated in the combustion chamber in the first fuel injection can be decreased, whereby the amount of white smoke generated in large amounts soon after starting the engine can be reduced.

According to the fifth embodiment of the present invention, in addition to the effect of the fourth embodiment, since the non-fuel injection time is varied depending on the engine temperature, the white smoke is reduced and the optimal engine starting time is set so that efficient engine starting can be performed.

According to the sixth embodiment of the present invention, in addition to the effect of the fifth embodiment, since the non-fuel injection time is varied depending on the coolant water temperature, the engine temperature most suitable for starting the engine can be calculated and more efficient engine starting can be performed.

According to the seventh embodiment of the present invention, the battery power is stable without being rapidly decreased, and the continuous operating time of the starter does not become longer than the predefined time, so the burden on the battery or the starter can be reduced.

According to the eighth embodiment of the present invention, in addition to the effect of the seventh embodiment, since re-cranking is repeated until the engine is started, an operator need not turn on the engine starting switch again and again, thereby improving the usability.

According to the ninth embodiment of the present invention, in addition to the effect of the fourth embodiment, since the first explosion is easily performed, and the compression end temperature of the cylinder engine in which the fuel is secondly injected is increased due to the torque by the cylinder engine in which the first explosion was made, and the ignition is enhanced, the fuel having no contribution to the combustion accumulated in the combustion chamber can be decreased, whereby the amount of white smoke generated in large amounts soon after starting the engine can be further reduced.

According to the tenth embodiment of the present invention, in addition to the effect of the fourth embodiment, since the fuel pressure feeding quantity from the high-pressure pump to the common rail just after starting the cranking needs not to be maximized, the driving force of the high-pressure pump needed soon after starting the cranking can be reduced. The burden on the starter can be lowered, whereby the cranking rotation speed is increased.

According to the eleventh embodiment of the present invention, in addition to the effect of the fourth embodiment, the excessive burden on the battery is decreased so that the impossibility of starting the engine can be avoided.

BRIEF DESCRIPTION OF THE DRAWINGS/FIGURES

FIGS. 3 (1) and (2) are time charts for the fuel injection control device for the diesel engine as shown in FIG. 1, and FIG. 3 (3) is a time chart for the conventional fuel injection control device for the diesel engine.

Figure 2:
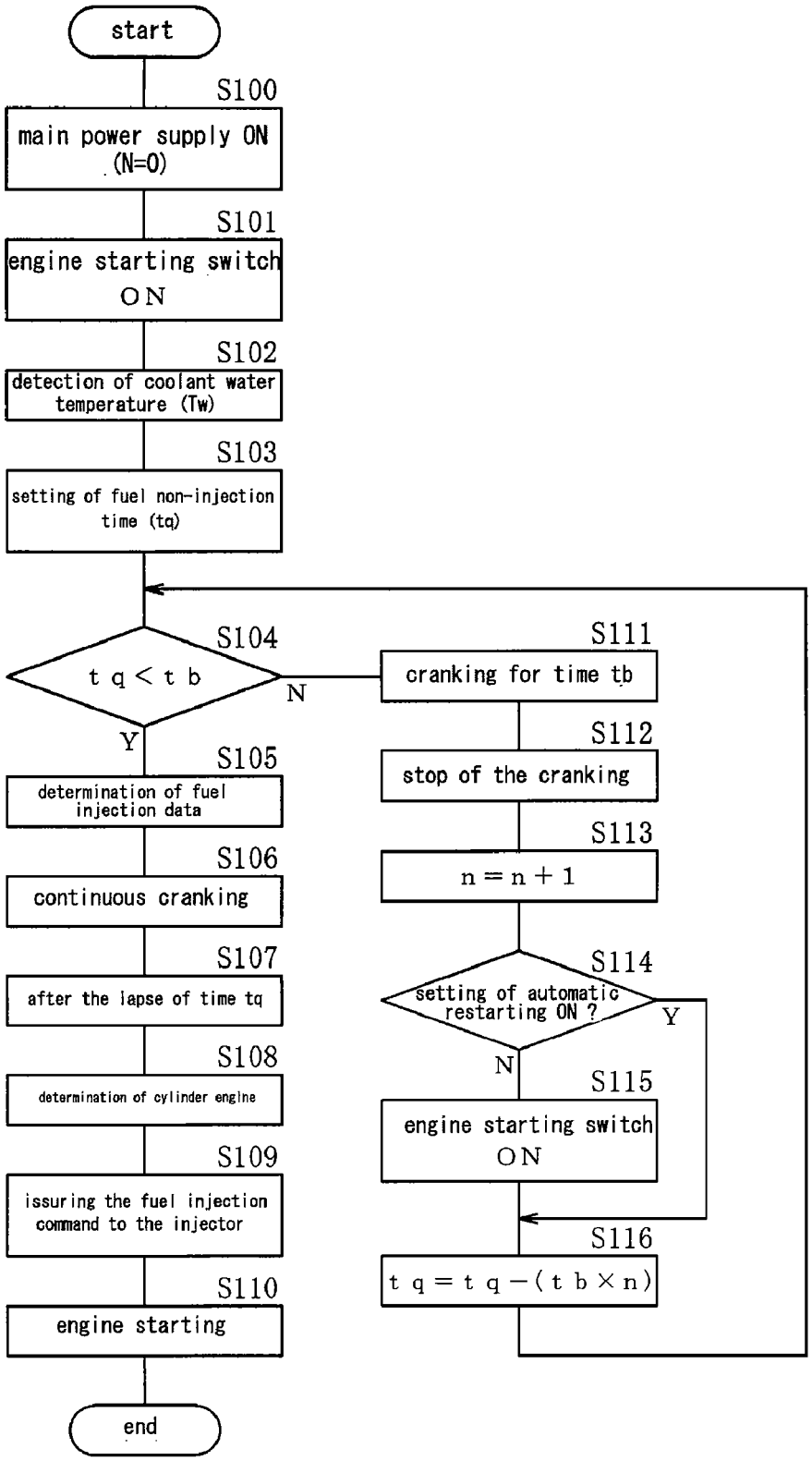
FIG. 2 is a flow diagram illustrating the behavior of a fuel injection control according to the first embodiment of the present invention.
Figure 4:
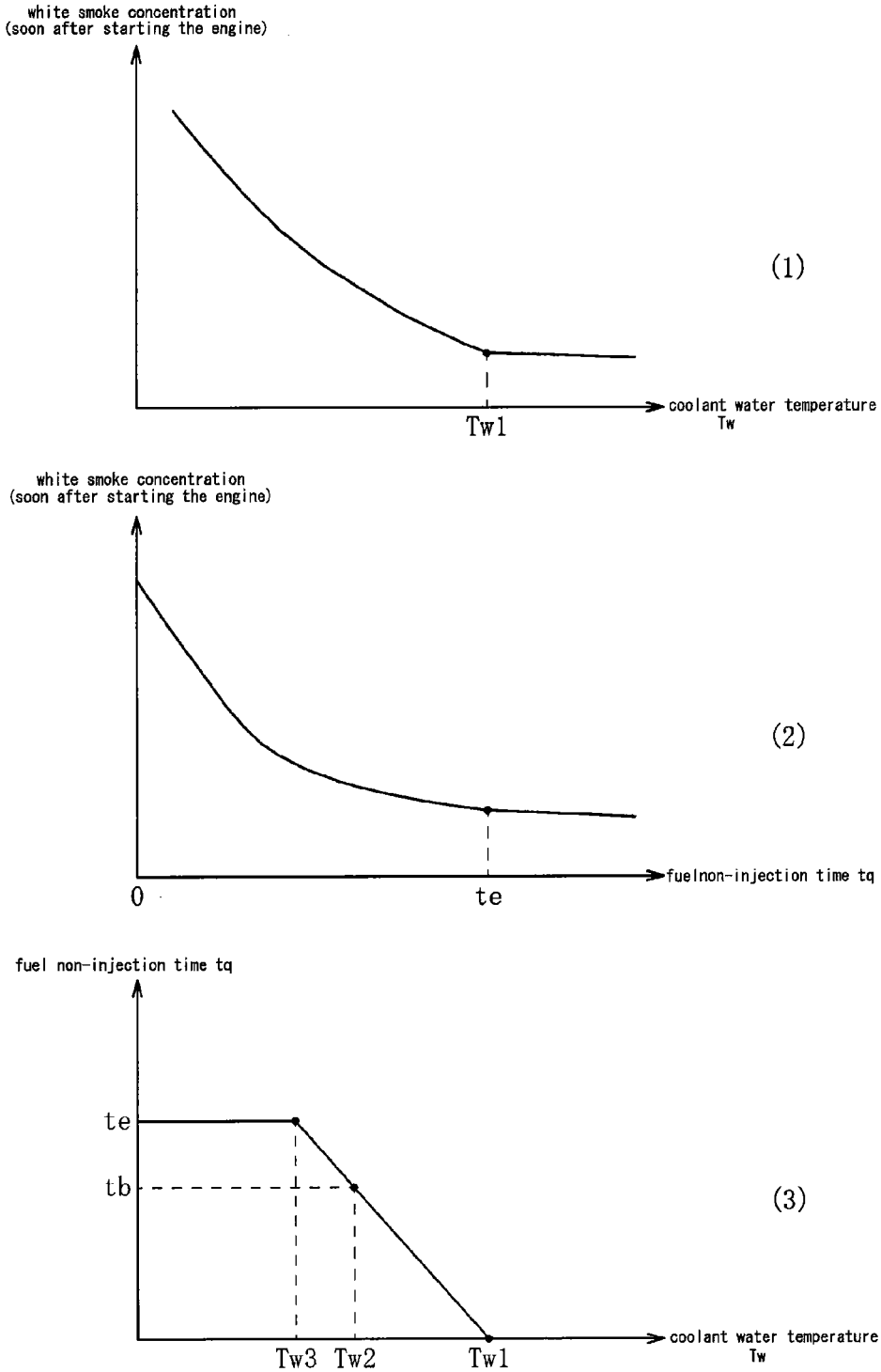

FIG. 4 (1) is a diagram illustrating a relationship between white smoke concentration and coolant water temperature Tw in the conventional fuel injection control device for the diesel engine. FIG. 4 (2) is a diagram illustrating a relationship between the white smoke concentration soon after starting the engine and the non-fuel injection time tq as shown in FIG. 2. FIG. 4 (3) is a diagram illustrating a relationship between the non-fuel injection time tq as shown in FIG. 2 and the coolant water temperature Tw.

Figure 1:
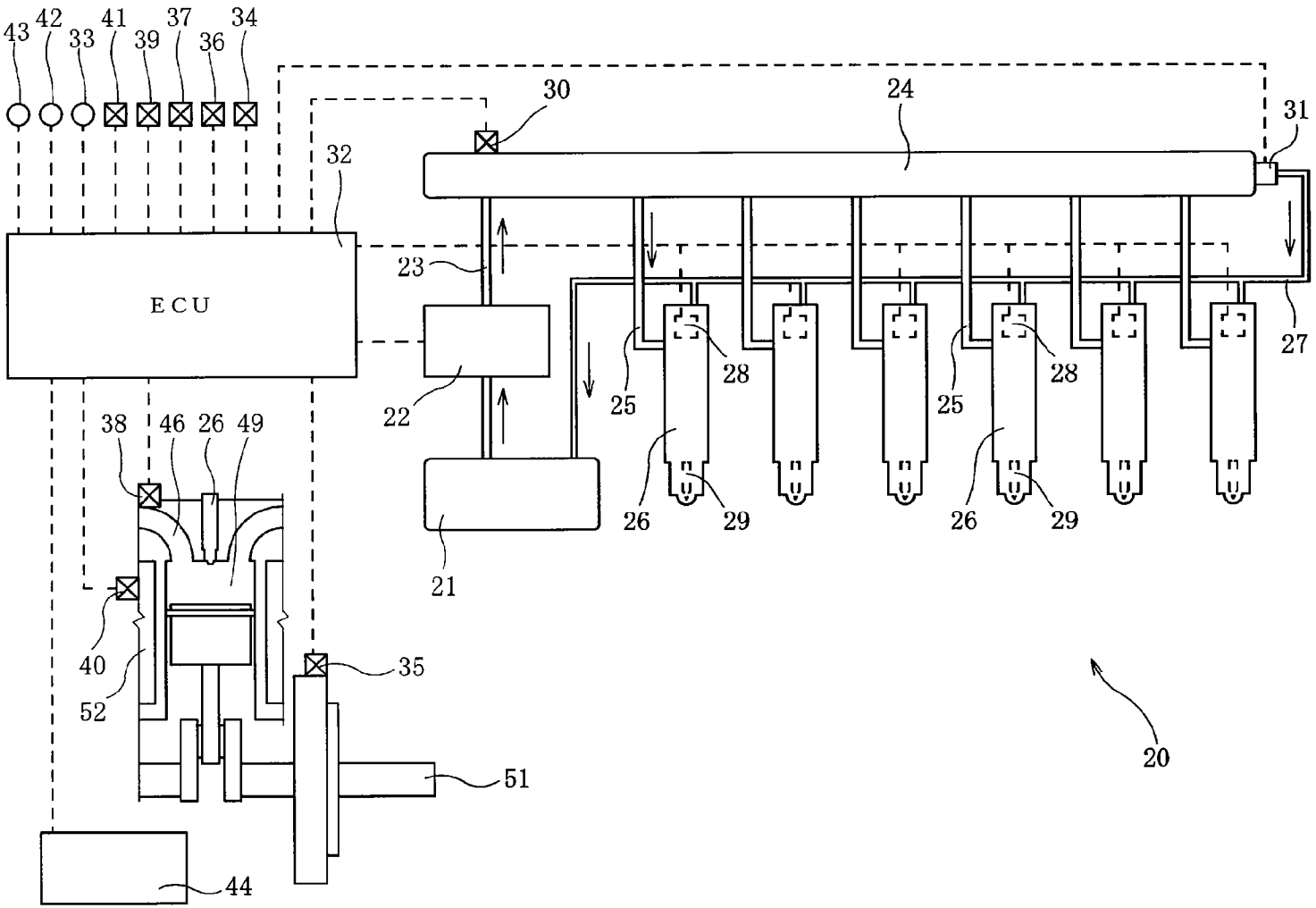
FIG. 1 is a block diagram illustrating a schematic construction of a fuel injection control device for a diesel engine according to the first embodiment of the present invention.
Figure 5:
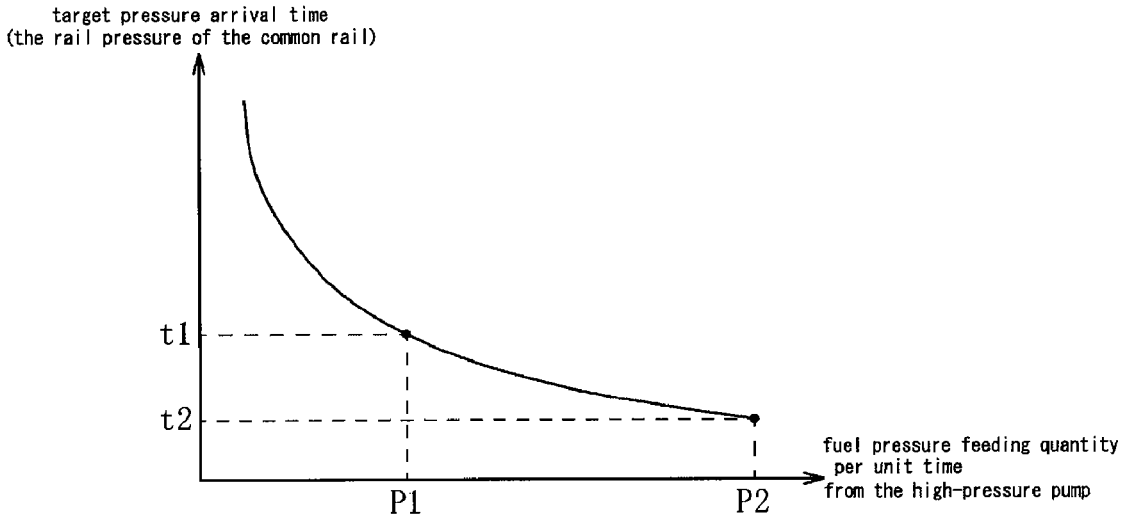

FIG. 5 is a diagram illustrating a relationship between a target pressure arrival time of the rail pressure in the common rail and the fuel pressure feeding quantity per unit time from the high-pressure pumping the fuel injection control device for the diesel engine as shown in FIG. 1.

Figure 6:
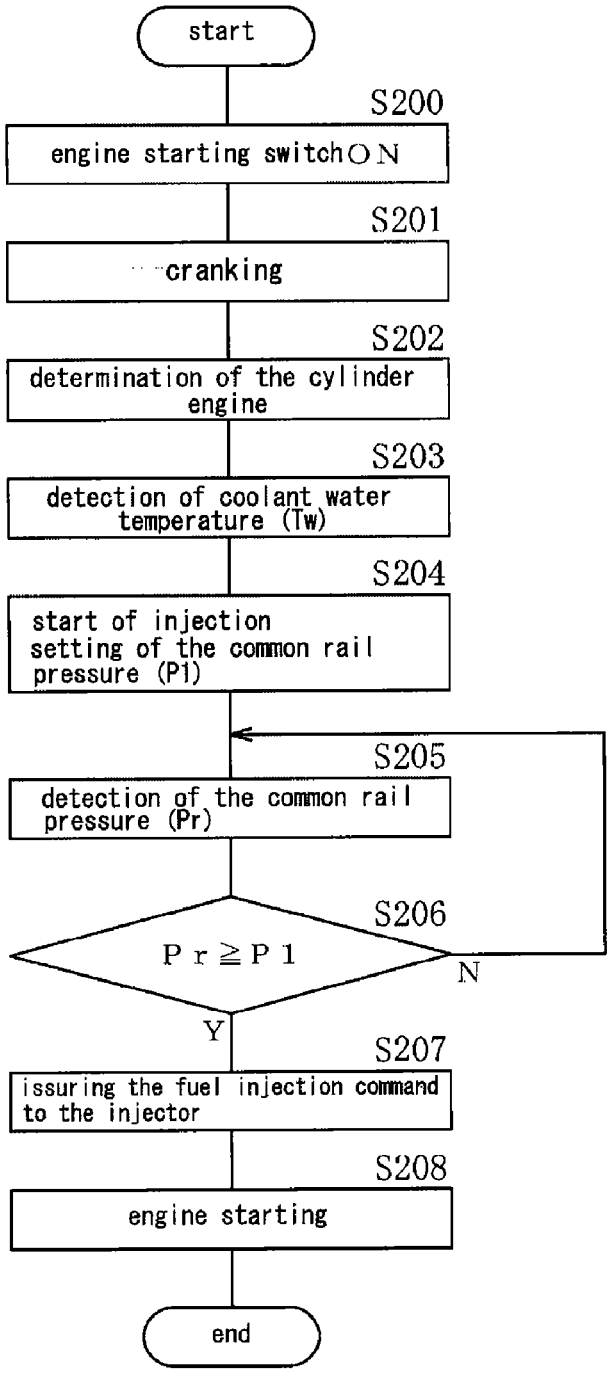

FIG. 6 is a flow diagram illustrating the behavior of a fuel injection control according to the second embodiment of the present invention.

Figure 7:
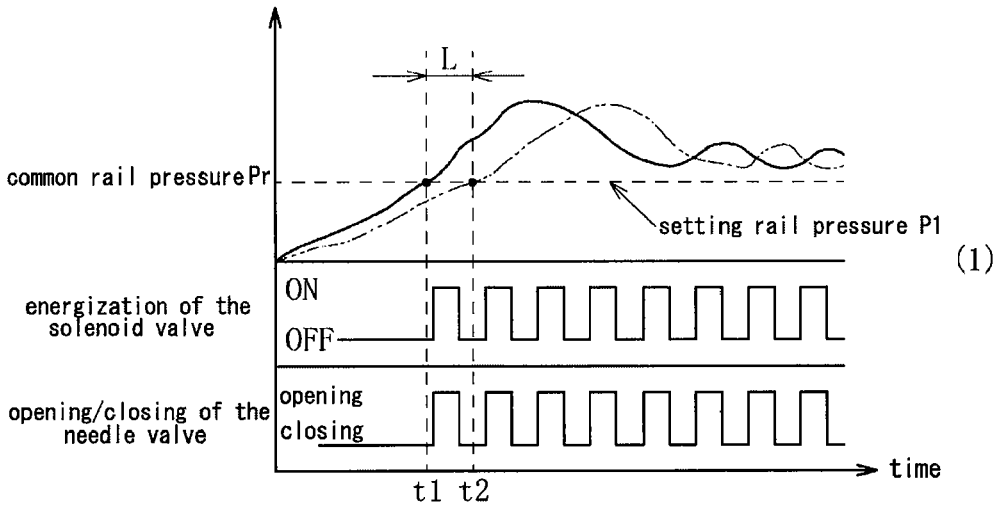
Figure 7:
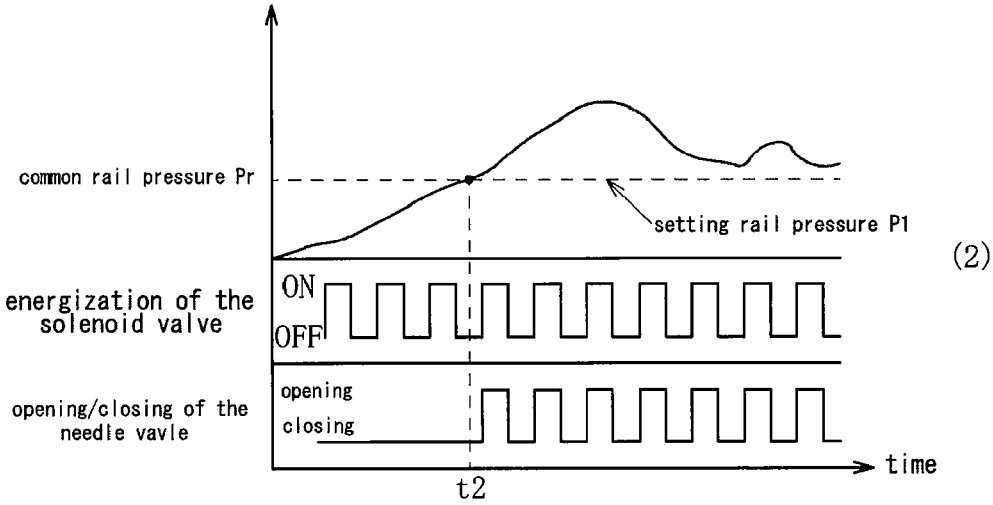

FIG. 7 is a diagram illustrating a relationship between the common rail pressure, the energization of the solenoid valve, the opening/closing of a needle valve and time. FIG. 7 (1) is a diagram for the fuel injection control device for the diesel engine as shown in FIG. 1, and FIG. 7 (2) is a diagram for the conventional fuel injection control device for the diesel engine.

Figure 8:
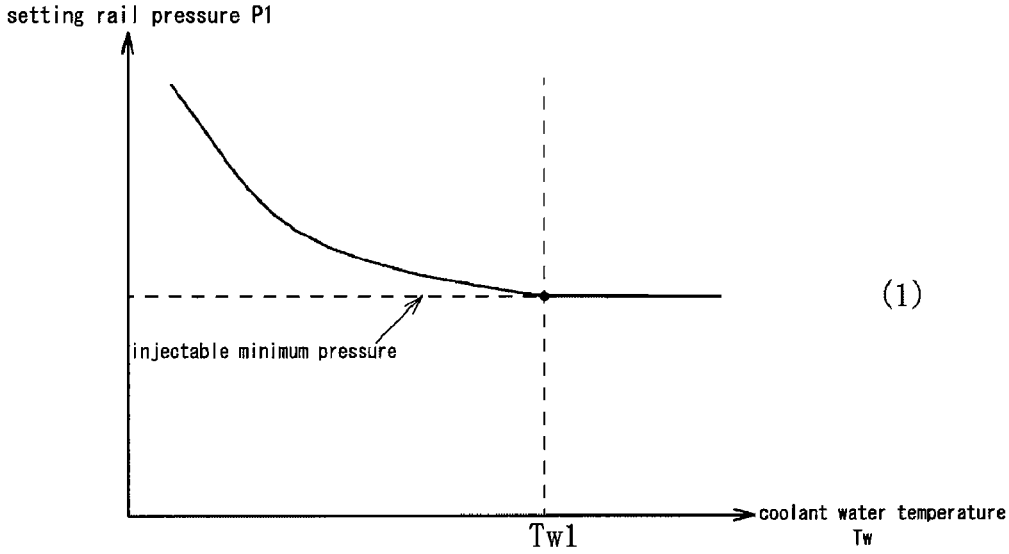
Figure 8:
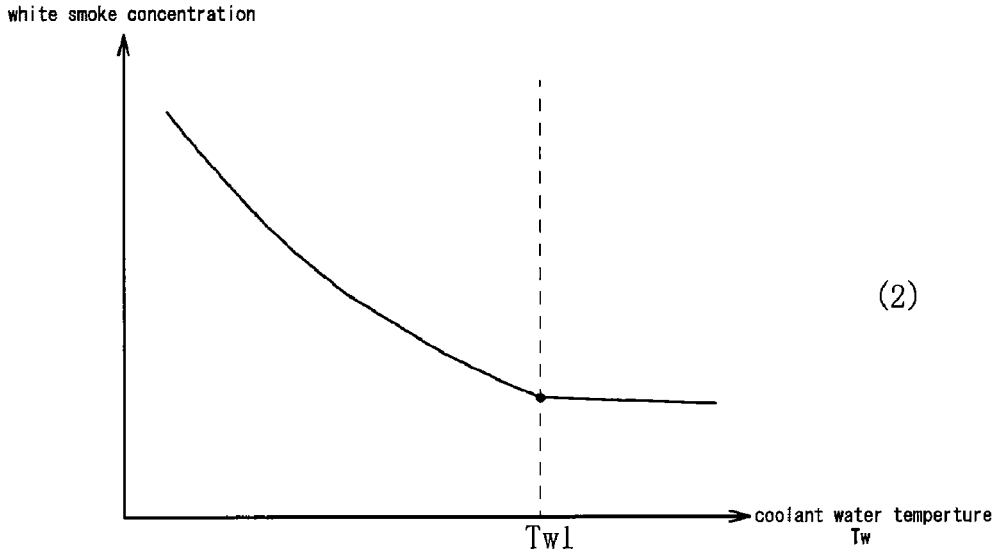

FIG. 8 (1) is a diagram illustrating a relationship between the setting rail pressure P1 and the coolant water temperature Tw as shown in FIG. 6. FIG. 8 (2) is a diagram illustrating a relationship between the white smoke concentration and the coolant water temperature Tw in the conventional fuel injection control device for the diesel engine.

DETAILED DESCRIPTION OF THE INVENTION

Next, embodiments of the present invention will be described with reference to the drawings.

FIG. 1 is a block diagram illustrating a schematic construction of a fuel injection control device for a diesel engine according to the first embodiment of the present invention.

Referring to FIG. 1, a fuel injection control device for a diesel engine 20 comprises a fuel tank 21, a high-pressure pump 22 that inhales a suitable amount of fuel from the fuel tank 21 and that sends high-pressure fuel through a fuel supply pipe 23 into a common rail 24, a common rail 24 that accumulates the high-pressure fuel, injectors 26 that inject the high-pressure fuel fed from the common rail 24 through high-pressure fuel pipes 25 into a fuel chamber 49, a starter 44 for performing a cranking, an ECU 32 as a control means for controlling them and various sensors or the like.

The common rail 24 includes a rail pressure sensor 30 and a pressure regulating valve 31. The ECU 32 detects the fuel pressure in the common rail 24 by the rail pressure sensor 30, and the fuel pressure is always regulated to an optimal pressure by opening or closing the pressure regulating valve 31. In other words, a stable injection pressure can be secured when an engine rotates at low speed and so on, regardless of an engine rotation speed or a load.

The respective injectors 26, which are provided with each of the cylinder engines, each include a solenoid valve 28 that opens or closes by an ON/OFF signal from the ECU32 and a needle valve 29 for injecting the fuel into the fuel chamber 49 at high pressure. When the solenoid valve 28 is energized and is opened, part of the high-pressure fuel flows out to a surplus fuel pipe 27, and the pressure behind the needle valve 29 is lowered so as to move up the needle valve 29 and open its that the fuel injection is performed. When the energization of the solenoid valve 28 is stopped, the high-pressure fuel is supplied behind the needle valve 29 again so as to move down the needle valve 29 and close its that the fuel injection is terminated. In the common rail fuel injection control device 20, the ECU 32 issues a signal to each of the solenoid valves 28 of the injectors 26, whereby the fuel injection timing and the injection quantity are controlled.

The ECU32 controls the fuel injections by the injectors 26 based on signals from the various sensors, internal programs and data. The ECU32 controls the high-pressure pump 22 and calculates a target pressure for the common rail 24 based on the engine condition. It also adjusts the amount of high-pressure fuel supplied to the common rail 24 so that the output from the rail pressure sensor 30 becomes the target value. The ECU32 is electrically connected to various sensors, such as a cylinder engine determining sensor 34 provided with a camshaft, an engine rotation speed sensor 35 provided with a crankshaft 51 or a flywheel, an acceleration opening degree sensor 36, an intake pressure sensor 37, an intake temperature sensor 38 provided with an intake port 46, a fuel temperature sensor 39, a coolant water temperature sensor 40 provided with a water jacket 52 formed outside of the combustion chamber 49 and a lubricant oil temperature sensor 41, including an engine starting switch 33 that transmits a starter signal to the ECU 32 and the starter 44. The ECU32 also includes a non-fuel injection time setting means 42 for setting up the after-mentioned non-fuel injection time tq and a battery voltage detecting means 43 for detecting a battery voltage (not shown). The ECU32 controls the engine by the signals transmitted from the aforementioned various sensors or the like.

Next, the first embodiment of a fuel injection control at the time of starting the engine will be described.

FIG. 2 is a flow diagram illustrating the behavior of the fuel injection control according to the first embodiment of the present invention.

Referring to FIG. 2, when a main power supply of the ECU 32 is turned on (S100, n=0), an operator turns on the engine starting switch 33 (S 101). The ECU32 detects the coolant water temperature Tw as the engine temperature by the signal from the coolant water temperature sensor 40 (S 102). The ECU32 sets up the non-fuel injection time tq when a fuel injection command is not issued in a given period of time by the non-fuel injection time setting means 42 based on the coolant water temperature Tw detected at Step S 102 (S 103). The non-fuel injection time tq is set up to be longer when the coolant water temperature Tw is lower. When the non-fuel injection time tq set up at Step S 103 is shorter than the available continuous cranking time tb, i.e., tq<tb (tq is smaller than tb), (Yes, at S 104), fuel injection data such as the fuel injection timing, the fuel injection quantity and the fuel injection pattern are determined (S 105). The aforementioned available continuous cranking time tb is a predetermined time calculated using the continuous operating time of the starter 44 or the limitation of the rapid depletion of the battery power or the like, which is preliminarily set up. The cranking is continuously performed by the operation of the starter 44 using the battery power (S 106). When the non-fuel injection time tq set up at Step S 103 goes by (S 107), the ECU32 determines the cylinder engine in which the intake air temperature is increased the most by the signal from the cylinder engine determining sensor 34 (S 108). The ECU32 issues the first fuel injection command to the injector 26 attached to the cylinder engine determined at Step S 108 (S 109). The fuel injection is started by energizing the solenoid valve 28 of the injector 26, and the engine is started (S 110).

In this regard, the cylinder engine in which the intake air temperature is increased the most as mentioned above means the cylinder engine closest to a means for warming the intake air of the engine starting at a low temperature. For example, when multiple cylinder engines are arranged in series as in the present embodiment, an air heater as the means for warming the intake air is disposed at an inlet for the intake air of an intake manifold. Because the intake air warmed by the air heater is supplied to the respective cylinder engines, the cylinder engine closest to the mounting location of the air heater becomes the cylinder engine in which the intake air temperature is increased the most.

Meanwhile, when it is not the case that tq<tb at Step S 104 (No, at S 104), the cranking is continuously performed for the above-mentioned tb time (S111), and the cranking is stopped once (S 112). Since the cranking is stopped, the battery voltage is recovered. Next, in the case when n=n+1, i.e., n=1 (S 113), the operator turns on the engine starting switch again (S 115, No, at S 114). In this regard, when an automatic restart is set up, the operator need not turn on the engine starting switch again, and Step S 115 is omitted (Yes, at S 114). The ECU 32 newly sets the non-fuel injection time (tq−(tb×n)), i.e., (tq−(tb×1) (S 116). Retuning to Step S 104 again, when tq<tb with respect to the non-fuel injection time tq newly set up at Step S 116 (Yes, at S 104) after the fuel injection data is determined (S 105), re-cranking is performed (S 106). When the non-fuel injection time tq newly set at Step S 116 goes by (S 107), as with the case of n=0, the determination of the cylinder engine (S 108) and the first fuel injection command to the injector 26 (S 109) are performed, so that the engine is started due to the fuel injection (S 110). Until the non-fuel injection time tq newly set satisfies the condition tq<tb (Yes, at S 104), the continuous cranking for the tb time is repeated (S 111 to S 116, No, at S 104).

Incidentally, when the main power supply of the ECU 32 is turned on, the ECU 32 detects the battery voltage for use in the fuel injection control device for the diesel engine 20 by the battery voltage detecting means 43. When the detected battery voltage is a predetermined value or lower, the ECU 32 ensures that the fuel injection control is not performed before the engine starting switch is turned on at Step S 101. Due to the above setting, the excessive burden is not placed on the battery, whereby the incapability of the engine starting can be avoided.

Next, an explanation will be given on the relationship between the cranking, the energization of the solenoid valve and the non-fuel injection time tq in the fuel injection control at the time of starting the engine as described above.

Figure 3:
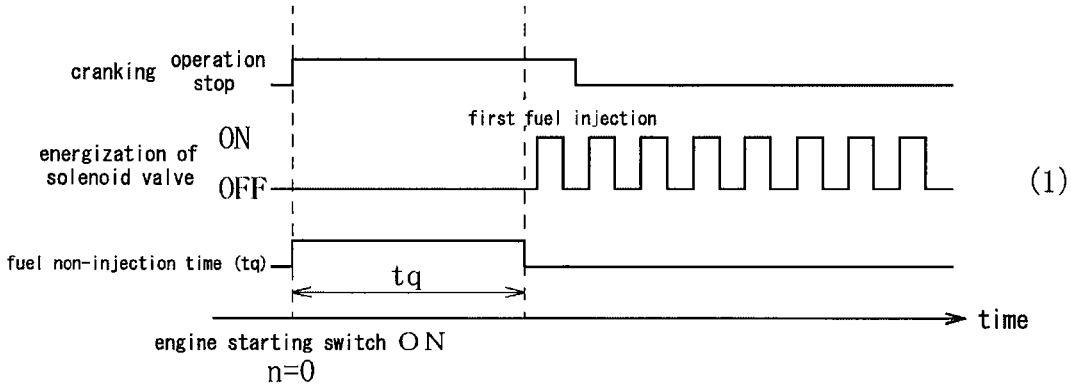
FIG. 3 is a time chart illustrating a relationship between cranking, the energization of a solenoid valve and the non-fuel injection time.
Figure 3:
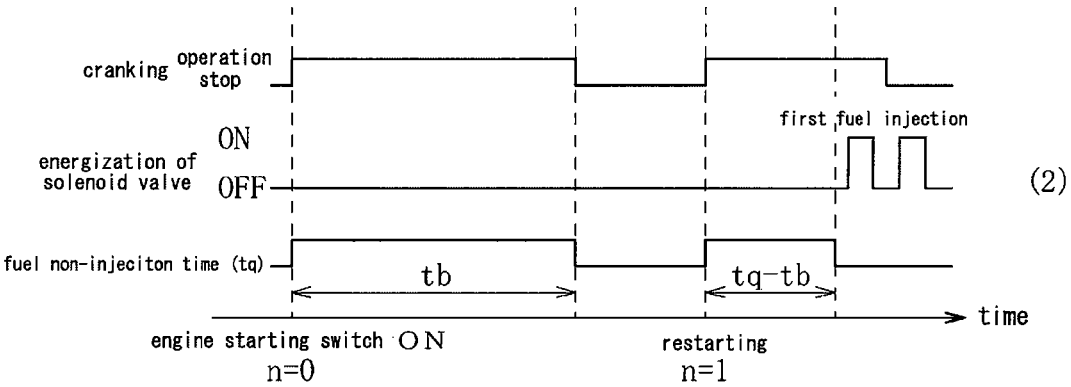
Figure 3:
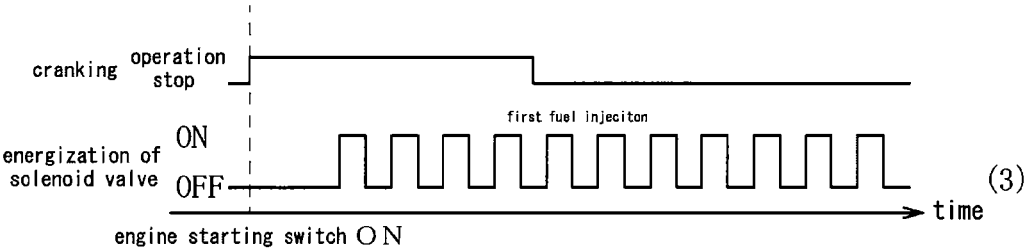

FIG. 3 is a time chart illustrating a relationship between cranking, the energization of a solenoid valve and the time when fuel is not injected. FIGS. 3 (1) and (2) are time charts for the fuel injection control device for the diesel engine as shown in FIG. 1, and FIG. 3 (3) is a time chart for the conventional fuel injection control device for the diesel engine.

Referring to FIG. 3 (1), the lapsed time after the engine starting switch is turned on is used as the axis of abscissas, which shows the operating or stopping condition of the cranking, the ON/OFF condition of the solenoid valve and the non-fuel injection time tq from the top. FIG. 3 (1) shows the case of n=0 and tq<tb (Yes, at S 104 in FIG. 2) in the flow diagram as shown in FIG. 2. When the engine starting switch is turned on, the starter operates and the cranking is started so that the solenoid valve 28 is energized after the lapse of the non-fuel injection time tq. The fuel is injected and ignited due to the first energization of the solenoid valve 28, whereby the first explosion is performed.

Referring to FIG. 3 (2), FIG. 3 (2) is the time chart having the same construction as FIG. 3 (1), and is the case where n is zero and tq is not smaller than tb (No, at S 104 in FIG. 2), and where n is 1 and tq is smaller than tb (Yes, at S 104 in FIG. 2). When the engine starting switch is turned on, the starter operates and the cranking is started so that the cranking is stopped as soon as the available continuous cranking time tb goes by. After the lapse of the predetermined time, the starter operates again and re-cranking is started, whereby the solenoid valve 28 is energized after the lapse of the non-fuel injection time (tq−tb) newly set up. As with the case of FIG. 3 (1), the fuel is injected and ignited due to the first energization of the solenoid valve 28, whereby the first explosion is performed.

Referring to FIG. 3 (3), in case of the conventional fuel injection control device for the diesel engine, the energization of the solenoid valve is performed just after starting the cranking, and the fuel is injected and ignited, whereby the first fuel explosion is performed after the energization is repeated several times.

An explanation will be given on the relationship between the white smoke concentration and the coolant water temperature Tw, the relationship between the white smoke concentration and the non-fuel injection time tq as well as the relationship between the non-fuel injection time tq and the coolant water temperature Tw.

FIG. 4 (1) is a diagram illustrating a relationship between white smoke concentration and coolant water temperature Tw in the conventional fuel injection control device for the diesel engine. FIG. 4 (2) is a diagram illustrating a relationship between the white smoke concentration and the non-fuel injection time tq. FIG. 4 (3) is a diagram illustrating a relationship between the non-fuel injection time tq and the coolant water temperature Tw.

Referring to FIG. 4 (1), the white smoke concentration of the white smoke generated soon after starting the engine is used as the axis of ordinate, and the coolant water temperature Tw detected at Step S 102 as shown in FIG. 2 is used as the axis of abscissas. The white smoke concentration is not really varied when the coolant water temperature Tw is Tw1 or higher, and it becomes higher as the coolant water temperature Tw becomes lower in the area where the coolant water temperature Tw is lower than Tw1. Therefore, when the non-fuel injection time tq is set in the area where the coolant water temperature Tw is lower than Tw1, the white smoke generated immediately after starting the engine can be effectively reduced.

Referring to FIG. 4 (2), the white smoke concentration generated soon after starting the engine is used as the axis of ordinate, and the non-fuel injection time tq set at Step S 103 as shown in FIG. 2 is used as the axis of abscissas. The non-fuel injection time tq is set up, whereby the white smoke concentration is reduced. The white smoke concentration is reduced as the non-fuel injection time tq becomes longer and is substantially constant from the time when the non-fuel injection time is tq until it becomes te.

Referring to FIG. 4 (3), the non-fuel injection time tq set at Step S 103 as shown in FIG. 2 is used as the axis of ordinate, and the coolant water temperature Tw detected at Step S 102 as shown in FIG. 2 is used as the axis of abscissas. Because when the coolant water temperature Tw is Tw1 or higher in FIG. 4 (1) the white smoke concentration not really varied, the non-fuel injection time tq may be set at zero when the coolant water temperature Tw is Tw1 or higher. Because the white smoke concentration is substantially constant from the time when the non-fuel injection time is tq until it becomes te in FIG. 4 (2), the non-fuel injection time tq may be set up at the constant value te when the coolant water temperature Tw is Tw3 or lower. When the coolant water temperature Tw is Tw2, the non-fuel injection time tq becomes the available continuous cranking time tb, and when the coolant water temperature Tw detected at Step S 102 is Tw2 or lower, the engine is restarted so that the non-fuel injection time tq is newly set.

As seen from above, in the fuel injection control device 20 in which the first fuel injection command is performed after the lapse of the non-fuel injection time tq as shown in the flow diagram of FIG. 2, since the temperature in the combustion chamber is increased due to the cranking during the non-fuel injection time tq, and the rail pressure of the common rail 24 is increased during the non-fuel injection time, the fuel having no contribution to the combustion accumulated in the combustion chamber at the first fuel injection can be decreased, and a large amount of white smoke generated just after starting the engine can be reduced. As shown in the time chart of FIG. 3, the ignition and the first fuel injection can be performed from the fuel injection command due to the energization to the solenoid valve 28. Moreover, as the non-fuel injection time tq is set up depending on the coolant water temperature Tw of one of the engine temperatures (S 103 in FIG. 2), the generation of the white smoke is reduced and the optimal engine starting time is set so that the engine can be efficiently started. In the above-mentioned fuel injection control, the cranking is not continuously performed at the non-fuel injection state beyond the available continuous cranking time tb. Accordingly, since the battery power is not rapidly decreased and constant and the continuous operating time of the starter 44 is not the predetermined time or longer, the burden on the battery and the starter 44 can be lowered.

Since re-cranking is repeated until the engine starting when the engine automatic restarting is set up (Yes, S 114 in FIG. 2), the operator need not turn on the engine starting switch again and again, whereby the usability is improved. The fuel injection command is issued to the injector 26 attached to the cylinder engine having the highest intake air temperature. Consequently, since the first fuel injection is easily performed and the compression end temperature of the cylinder in which the fuel is secondly injected is increased due to the torque by the cylinder that the fuel has been firstly injected, the ignition is enhanced, the fuel having no contribution to the combustion accumulated in the combustion chamber can be further decreased and the large amount of white smoke generated soon after starting the engine can be further reduced.

Next, an explanation will be given on the target pressure arrival time of the rail pressure in the common rail 24 using the non-fuel injection time tq.

FIG. 5 is a diagram illustrating a relationship between the target pressure arrival time of the rail pressure in the common rail 24 and the fuel pressure feeding quantity per unit time from the high-pressure pump 22.

Referring to FIG. 5, the target pressure arrival time of the rail pressure in the common rail 24 is used as the axis of ordinate, and the fuel pressure feeding quantity per unit time from the high-pressure pump 22 is used as the axis of abscissas. It is illustrated that as the target pressure arrival time becomes shorter, the fuel pressure feeding quantity per unit time from the high-pressure pump 22 becomes larger. In the conventional fuel injection control device for the diesel engine, in order to increase the rail pressure in the common rail 24 at the time of starting the engine, the fuel pressure feeding quantity per unit time from the high-pressure pump is set up to be maximized immediately after the cranking For example, this is in the case when the target pressure arrival time is t2 and the fuel pressure feeding quantity per unit time is P2. Compared with this, in the fuel injection control device 20 having the non-fuel injection time tq, the target pressure arrival time of the rail pressure in the common rail 24 can be set up to be longer using the non-fuel injection time tq. For example, this can be achieved if the time until the fuel injection command including the non-fuel injection time tq is performed is defined as the target pressure arrival time t1, and in the meantime the rail pressure in the common rail 24 reaches the target pressure. At this time, the fuel pressure feeding quantity per unit time is P1 and can be reduced much more than the conventional quantity per unit time P2. Therefore, as the fuel pressure feeding quantity supplied from the high-pressure pump 22 to the common rail 24 soon after starting the cranking needs not to be maximized, the driving force of the high-pressure pump 22 needed soon after starting the cranking can be lowered. The burden on the starter 44 can be reduced, thereby increasing the cranking rotation speed.

In this regard, in the aforementioned embodiment, the non-fuel injection time is set up corresponding to the coolant water temperature, but it may be set up to be constant within the limit of the available continuous cranking time.

In the aforementioned embodiment, also, the coolant water temperature is used as the engine temperature, but the intake temperature, lubricant oil temperature or the fuel temperature or the like may be available. They can be used to evaluate the engine temperature, and a combination thereof including the coolant water temperature may be also used.

Further, in the aforementioned embodiment, although six injectors are used, one or more injectors may be used.

Next, the second embodiment of the fuel injection control at the time of starting the engine will be described.

FIG. 6 is a flow diagram illustrating the behavior of a fuel injection control according to the second embodiment of the present invention.

Referring to FIG. 6, when turning on the engine starting switch such as the starter 33 (S200), the cranking is started (S201). The ECU 32 determines the cylinder engine that the fuel should be firstly injected by the signal from the cylinder engine determining sensor 34 (S202). Then, the ECU 32 detects the coolant water temperature Tw as the engine temperature by the signal from the coolant water temperature sensor 40 (S203). The ECU 32 sets up the common rail pressure P1 capable of starting the fuel injection based on the coolant water temperature Tw detected at Step S 203 (S204). The ECU 32 detects the present common rail pressure Pr by the signal from the rail pressure sensor 30 (S205). The ECU 32 evaluates whether the common rail pressure Pr detected at Step S 205 is the common rail pressure P1 set at Step S 104 or higher (S206). When Pr is P1 or higher than P1 ($Pr \geqq P1$) (Yes, at S 206), the ECU 32 issues the first fuel injection command to the injector 26 (S207). The fuel injection starts by energizing the solenoid valve 28 of the injector 26, whereby the engine is started (S208). When Pr is smaller than P1 ($Pr < P1$) at Step S 206, the ECU 32 detects the common rail pressure Pr, and returns to Step S 205 again.

Here, an explanation will be given on a relationship between the common rail pressure, the energization of the solenoid valve and the opening/closing of the needle valve at the time of starting the engine.

FIG. 7 is a diagram illustrating a relationship between the common rail pressure Pr, the energization of the solenoid valve, the opening/closing of a needle valve and time. FIG. 7

(1) is a diagram for the fuel injection control device for the diesel engine as shown in FIG. 1, and FIG. 7 (2) is a diagram for the conventional fuel injection control device for the diesel engine.

Referring to FIG. 7 (1), the common rail pressure Pr at the time of starting the engine is used as the axis of ordinate, and the lapsed time is used as the axis of abscissas. The On/OFF state of the solenoid valve and the opening/closing state of the needle valve are illustrated below the diagram which shows the time passage of the common rail pressure Pr. The common rail pressure P1 capable of starting the fuel injection set up at the above-mentioned Step S 204 is shown with a dotted line. The common rail pressure reaches the set rail pressure P1 at the time t1 and then the solenoid valve is energized, so as to open the needle valve. The time of the energization of the solenoid valve coincides with the time of the opening of the needle valve from the beginning.

Meanwhile, referring to FIG. 7 (2), in the case of the conventional fuel injection control device, because the fuel injection starting command is issued from the ECU 32 soon after the cranking, the solenoid valve is energized before the time t2 when the common rail pressure Pr reaches the pressure P1 capable of starting the fuel injection. However, since the common rail pressure Pr does not reach the pressure P1 capable of injecting the fuel, the needle valve is not opened due to the lack of pressure. Therefore, the time of the energization of the solenoid valve does not coincide with the time of the opening of the needle valve.

Returning to FIG. 7 (1), the time passage of the common rail pressure Pr in the conventional fuel injection control device as illustrated in FIG. 7 (2) is shown with a two-dot chain line. In the fuel injection control device 20, it is indicated that the engine starting time is accelerated by the time L, compared with the conventional fuel injection control device. This means that as the needle valve 29 is not opened but the solenoid valve 28 is energized and opened in the conventional fuel injection control device, the fuel is leaked from the injector 26 to the surplus fuel pipe 27 so that the time until the common rail pressure Pr reaches the set injectable rail pressure P1 becomes longer.

An explanation will be given on the relationship between the set rail pressure P1 and the coolant water temperature Tw as well as the white smoke concentration and the coolant water temperature Tw.

FIG. 8 (1) is a diagram illustrating a relationship between the set rail pressure P1 and the coolant water temperature Tw as shown in FIG. 6. FIG. 8 (2) is a diagram illustrating a relationship between the white smoke concentration and the coolant water temperature Tw in the conventional fuel injection control device for the diesel engine.

Referring to FIG. 8 (1), the set rail pressure P1 capable of starting the fuel injection in the common rail 24 set at Step S 204 is used as the axis of ordinate, and the coolant water temperature Tw detected at Step S 203 is used as the axis of abscissas. The set rail pressure P1 is approximately constant at the injectable minimum pressure when the coolant water temperature Tw is Tw1 or higher. The set rail pressure P1 is set higher as the coolant water temperature Tw becomes lower when the coolant water temperature Tw is lower than Tw1.

Referring to FIG. 8 (2), the white smoke concentration of the white smoke generated just after starting the engine is used as the axis of ordinate, and the coolant water temperature Tw detected at Step S 203 is used as the axis of abscissas. The white smoke concentration is not really varied when the coolant water temperature Tw is Tw1 or higher, and it becomes higher as the coolant water temperature Tw become lower when the coolant water temperature Tw is lower than Tw1. Therefore, when the coolant water temperature Tw is lower than Tw1, the white smoke concentration of the white smoke generated just after starting the engine can be reduced by increasing the set rail pressure P1.

As seen from above, in the fuel injection control device 20, which the first fuel injection command just after the cranking is issued to the injector 26 after the common rail pressure Pr reaches the setting rail pressure P1 as shown in the flow diagram of FIG. 6, the fuel having no contribution to the combustion caused by the lack of rail pressure is not accumulated in the combustion chamber so the large amount of white smoke generated immediately after starting the engine can be reduced. The amount of fuel leaked from the injector 26 is decreased, and the time when the rail pressure reaches the pressure capable of injecting the fuel is shortened, thereby shortening the engine starting time. Because the set rail pressure P1 is varied depending on the coolant water temperature Tw as one of the engine temperatures, the generation of white smoke is reduced and the optimal engine starting time is set up, whereby efficient engine starting can be performed.

In this regard, in the aforementioned embodiment, the set rail pressure is set up depending on the coolant water temperature, but it may be set to be constant.

In the aforementioned embodiment, also, the coolant water temperature is used as the engine temperature, but the intake temperature, lubricant oil temperature or the fuel temperature or the like may be available. They can be used to evaluate the engine temperature, and a combination thereof including the coolant water temperature may be used also.

Further, in the aforementioned embodiment, although six injectors are used, one or more injectors may be used.

INDUSTRIAL APPLICABILITY

The present invention is applicable to the fuel injection control device for the diesel engine, especially in the fuel injection control device for the diesel engine controlling the first fuel injection command soon after the cranking at the time of starting the engine.

The invention claimed is:

1. A fuel injection control device for a diesel engine having a plurality of cylinders, comprising:

a high-pressure pump;

a common rail for accumulating fuel pressurized and delivered by the high-pressure pump;

a plurality of injectors attached to the respective cylinders of the diesel engine so as to inject the fuel supplied from the common rail into respective combustion chambers in the respective cylinders;

a starter for cranking the diesel engine by use of electric power of a battery, wherein the starter starts the cranking by turning on an engine starting switch;

a setting means for setting a non-fuel injection time;

an air heater disposed at an inlet of an intake manifold of the diesel engine so as to warm an intake air introduced into the inlet; and a control means that controls the high-pressure pump, the injectors and the starter so as to continue the cranking without fuel injection until lapse of the non-fuel injection time, and so as to command one of the injectors to perform an earliest fuel injection after the lapse of the non-fuel injection time, wherein, when the air heater is operated to warm the intake air, the injector commanded to perform the earliest fuel injection is an injector attached to the cylinder which is closer to the air heater than any other cylinder so as to have a highest intake air temperature of intake air temperatures of all the cylinders.

2. The fuel injection control device for the diesel engine as set forth in claim 1, further comprising:

a detecting means for detecting an engine temperature, wherein the setting means sets the non-fuel injection time based on the detected engine temperature.

3. The fuel injection control device for the diesel engine as set forth in claim 2, wherein the detecting means detects a coolant temperature and calculates an engine temperature based on the detected coolant water temperature so that the calculated engine temperature serves as the detected engine temperature.

4. The fuel injection control device for the diesel engine as set forth in claim 1, wherein a continuous cranking available time is preset for limiting the continuous cranking, wherein, in case that the set non-fuel injection time is not longer than the continuous cranking available time, the control means controls the starter and the injectors so as to continue the cranking without fuel injection until the lapse of the non-fuel injection time, and wherein, in case that the non-fuel injection time is longer than the continuous cranking available time, the control means controls the starter and the injectors so as to continue the cranking fuel injection until lapse of the continuous cranking available time and the setting means newly sets a new non-fuel injection time after the cranking is stopped at the lapse of the continuous cranking available time.

5. The fuel injection control device for the diesel engine as set forth in claim 4, wherein the starter automatically starts re-cranking to be performed during the new non-fuel injection time.

6. The fuel injection control device for the diesel engine as set forth in claim 1, wherein the quantity of the fuel pressurized and delivered by the high-pressure pump per unit time is controlled so that the time from the start of cranking until the earliest fuel injection approximately coincides with a time from the start of cranking until a rail pressure of the common rail reaches a target pressure.

7. The fuel injection control device for the diesel engine as set forth in claim 1, wherein the setting means and the control means are set so as not to perform the cranking without fuel injection based on the setting of the non-fuel injection time when a voltage of the battery is not higher than a predetermined value.

* * * * *